US008902036B2

(12) United States Patent
Kawai

(10) Patent No.: US 8,902,036 B2
(45) Date of Patent: Dec. 2, 2014

(54) FERRITE CLAMP

(75) Inventor: Hideharu Kawai, Nagoya (JP)

(73) Assignee: Kitagawa Industries Co., Ltd., Nagoya-Shi, Aichi (JP)

( * ) Notice: Subject to any disclaimer, the term of this patent is extended or adjusted under 35 U.S.C. 154(b) by 0 days.

(21) Appl. No.: 13/882,576

(22) PCT Filed: Nov. 2, 2011

(86) PCT No.: PCT/JP2011/075336

§ 371 (c)(1),
(2), (4) Date: Apr. 30, 2013

(87) PCT Pub. No.: WO2012/060422

PCT Pub. Date: May 10, 2012

(65) Prior Publication Data

US 2013/0222103 A1 Aug. 29, 2013

(30) Foreign Application Priority Data

Nov. 4, 2010 (JP) ..... 2010-247320

(51) Int. Cl.
*H01F 17/06* (2006.01)

(52) U.S. Cl.
USPC ..... 336/175

(58) Field of Classification Search
USPC ..... 336/174–175
See application file for complete search history.

(56) References Cited

U.S. PATENT DOCUMENTS

| | | | | |
|---|---|---|---|---|
| 5,162,772 | A * | 11/1992 | May | 336/92 |
| 6,259,346 | B1 * | 7/2001 | Nakano | 336/175 |
| 6,268,787 | B1 * | 7/2001 | Onizuka | 336/92 |
| 7,211,724 | B2 * | 5/2007 | Kobayashi | 174/36 |
| 7,319,376 | B2 * | 1/2008 | Kobayashi et al. | 336/175 |
| 2007/0120635 | A1 | 5/2007 | Kobayashi et al. | |

FOREIGN PATENT DOCUMENTS

| | | | |
|---|---|---|---|
| EP | 2493279 | A1 | 8/2012 |
| JP | 1-84494 | U | 6/1989 |
| JP | 3-21970 | U | 3/1991 |
| JP | 3-59693 | U | 6/1991 |
| JP | 4-5804 | A | 1/1992 |
| JP | 7-273485 | A | 10/1995 |
| JP | 9-83175 | A | 3/1997 |
| JP | 10-79589 | A | 3/1998 |

OTHER PUBLICATIONS

International Search Report Corresponding to PCT/JP2011/075336.
International Preliminary Report on Patentability Corresponding to PCT/JP2011/075336 mailed May 16, 2013.
Extended European Search Report corresponding to European Appln. No. 11838072.4 mailed Mar. 19, 2014.
Notice of Reasons for Rejection issued in corresponding Japanese Application No. 2010-247320 mailed on Oct. 1, 2013.

* cited by examiner

*Primary Examiner* — Tuyen Nguyen
(74) *Attorney, Agent, or Firm* — Davis & Bujold, PLLC; Michael J. Bujold

(57) ABSTRACT

A ferrite clamp includes a pair of divided cores, each being formed in an open circular shape; and a pair of case parts, each being adapted to hold each of the divided cores. When the case parts are assembled with each other, the pair of divided cores held by the case parts constitute a circular magnetic core having an insertion hole to insert an electric cable therethrough. The case part includes, in a portion thereof to hold an outer peripheral surface of the divided core, a protruding portion which is outwardly convex.

14 Claims, 9 Drawing Sheets

FERRITE CLAMP

CROSS-REFERENCE TO RELATED APPLICATIONS

This international application claims the benefit of Japanese Patent Application No. 2010-247320 filed Nov. 4, 2010 in the Japan Patent Office, the disclosure of which is incorporated herein by reference.

TECHNICAL FIELD

The present invention relates to a ferrite clamp that is, for example, attached to an electric cable of an electronic device or the like, to absorb a noise current, such as a noise current received by the electric cable as an antenna or a noise current generated externally and flowing into the electronic device through the electric cable.

BACKGROUND ART

There is conventionally known a ferrite clamp as a device for absorbing noise flowing through an electric cable. The ferrite clamp includes a ferrite core which can be attached around the electric cable. The ferrite core is a magnetic body. A noise current flowing through the electric cable is absorbed by the ferrite core.

The aforementioned ferrite clamp includes, for example, a pair of plastic case parts. The ferrite core is fixed in the pair of plastic case parts. Specifically, a cylindrical ferrite core is axially divided into halves (hereinafter, each core after being divided is referred to as a divided core), and the divided cores are fit in the pair of plastic case parts connected with a hinge. The electric cable is clamped from outside of the electric cable by the divided cores together with the case parts. That is, the ferrite clamp of a type described above is attached in a middle of the electric cable (see Patent Documents 1 and 2).

PRIOR ART DOCUMENT

Patent Document

Patent Document 1: Japanese Unexamined Patent Application Publication No. 4-5804

Patent Document 2: Japanese Unexamined Utility Model Application Publication No. 3-59693

SUMMARY OF THE INVENTION

Problems to be Solved by the Invention

There is a case where, in order to prevent a pair of case parts included in a ferrite clamp in a state of being attached to an electric cable from being separated from each other, outer peripheries of case parts P1 and P3 are secured with a clamping band P5 as shown in FIG. 8. A securing operation with the clamping band P5 is as described below.

(1) Inserting one end of the clamping band P5 into a locking member P7 provided at the other end of the clamping band P5.

(2) Inserting the case parts P1 and P3 of the ferrite clamp into a loop formed by the clamping band P5.

(3) Pulling the one end of the clamping band P5 opposite to the locking member P7 to thereby tighten the loop of the clamping band P5 and tighten the outer peripheries of the case parts P1 and P3 by the clamping band P5.

A configuration of the outer peripheries of the case parts is typically circular and outer peripheral surfaces of the case parts include no edge. In this case, when the one end of the clamping band is pulled, the loop of the clamping band rotates along the outer peripheries of the case parts, leading to poor workability.

Inside the case parts, in order to maintain a state where a pair of divided cores are joined, there are also provided resin springs that bias the divided cores toward respective opposite divided cores. To maintain the state where the pair of divided cores are joined firmly for a long time, it is required to increase a strength (a plate pressure) of the resin springs. When closing the pair of case parts, it is required to push the resin springs into the pair of case parts against the plate pressure of the resin springs. If the plate pressure of the resin spring is high, a large force is required to close the pair of case parts. For example, it may be difficult to close the pair of case parts with a single hand. In this case, workability when closing the pair of case parts will be lowered.

It is desirable to be able to solve at least one of the aforementioned problems.

Means for Solving the Problems (1) A ferrite clamp in a first aspect of the present application includes a pair of divided cores, each being formed in an open circular shape; and a pair of case parts, each being adapted to hold each of the divided cores. When the case parts are assembled with each other, the pair of divided cores held by the case parts constitute a circular magnetic core having an insertion hole to insert an electric cable therethrough. The case part includes, in a portion thereof holding an outer peripheral surface of the divided core, a protruding portion which is outwardly convex.

In the ferrite clamp of the present invention, the case part includes, in the portion thereof to hold the outer peripheral surface of the divided core, the protruding portion which is outwardly convex. Accordingly, when the pair of case parts assembled together are tightened by the clamping band, the protruding portion becomes engaged with teeth-like convexes and concaves formed in the clamping band. As a result, when tightening the clamping band, the clamping band is suppressed from sliding and rotating on the outer peripheral surfaces of the pair of case parts, and thus an improved workability can be achieved.

The protruding portion is formed in an outer peripheral surface of the case part. The protruding portion may be configured as a convex portion protruding outward of the case part relative to a surrounding area, for example, as a protruding portion 19*a* in FIG. 1 and FIG. 3, or the protruding portion 41*a* in FIG. 6 and FIG. 7. Also, the protruding portion is not limited to such convex portion. For example, any portion having a shape (or configuration) capable of entering into a concave portion of the teeth-like convexes and concaves formed in the clamping band may be employed as the protruding portion. For example, the protruding portion may be configured as an end portion 37*a* (a corner of an end face of a plate-like member) in FIG. 5.

(2) A ferrite clamp in a second aspect of the present application includes a pair of divided cores, each being formed in an open circular shape; and a pair of case parts, each being adapted to hold each of the divided cores. When the case parts are assembled with each other, the pair of divided cores held by the case parts constitute a circular magnetic core having an insertion hole to insert an electric cable therethrough. The case part includes, in a portion thereof to hold an outer peripheral surface of the divided core, an elastically deformable portion which protrudes outwardly relative to a surrounding area and is inwardly elastically deformable. The elastically deformable portion, when elastically deformed inwardly, pushes one of the divided cores toward the other one of the divided cores.

The ferrite core of the present invention may include the above described elastically deformable portion. When the elastically deformable portion is tightened from outside by the clamping band, the elastically deformable portion is pushed inwardly, to thereby push one of the divided cores toward the other one of the divided cores. As a result, a joining pressure between the pair of divided cores is maintained, and an improved long-term reliability can be achieved.

Since the joining pressure between the pair of divided cores may be maintained by means of the aforementioned mechanism, it is not necessarily required to provide, inside the pair of case parts, a spring mechanism that generates a force to press the divided cores against each other. Even in case of providing a spring mechanism, the spring mechanism need not have a high spring pressure. As a result, only a small force is required to close the pair of case parts against the spring pressure of the spring mechanism when fitting together the pair of case parts.

(3) A ferrite clamp in a third aspect of the present application is the ferrite clamp in the second aspect, wherein the elastically deformable portion includes, in an outer peripheral surface thereof, a protruding portion which is outwardly convex.

In the ferrite clamp of the present invention, the elastically deformable portion includes, in the outer peripheral surface thereof, the protruding portion which is outwardly convex. Accordingly, when the pair of case parts assembled together are tightened by the clamping band, the protruding portion becomes engaged with teeth-like convexes and concaves formed in the clamping band. As a result, when tightening the clamping band, the clamping band is suppressed from sliding and rotating on the outer peripheral surfaces of the pair of case parts, and thus an improved workability can be achieved.

The protruding portion may be configured as a convex portion protruding outward of the case part relative to a surrounding area, for example, as a protruding portion 19*a* in FIG. 1 and FIG. 3, or the protruding portion 41*a* in FIG. 6 and FIG. 7. Also, the protruding portion is not limited to such convex portion. For example, any portion, which has a shape (or configuration) capable of entering into a concave portion of the teeth-like convexes and concaves formed in the clamping band, may be employed as the protruding portion. For example, the protruding portion may be configured as an end portion 37*a* (a corner of an end face of a plate-like member) in FIG. 5.

(4) A ferrite clamp in a fourth aspect of the present application is the ferrite clamp in the second aspect or the third aspect, further including, in an outer peripheral surface of the case part, a guide portion to guide a clamping band at a path passing over the elastically deformable portion.

By including the guide portion, the ferrite clamp of the present invention may guide the clamping band to an appropriate position (such as a position of passing over the elastically deformable portion and going around the outer peripheries of the pair of case parts).

Hereinafter, embodiments of the present invention will be described with reference to the drawings.

EXPLANATION OF REFERENCE NUMERALS

Figure 1:
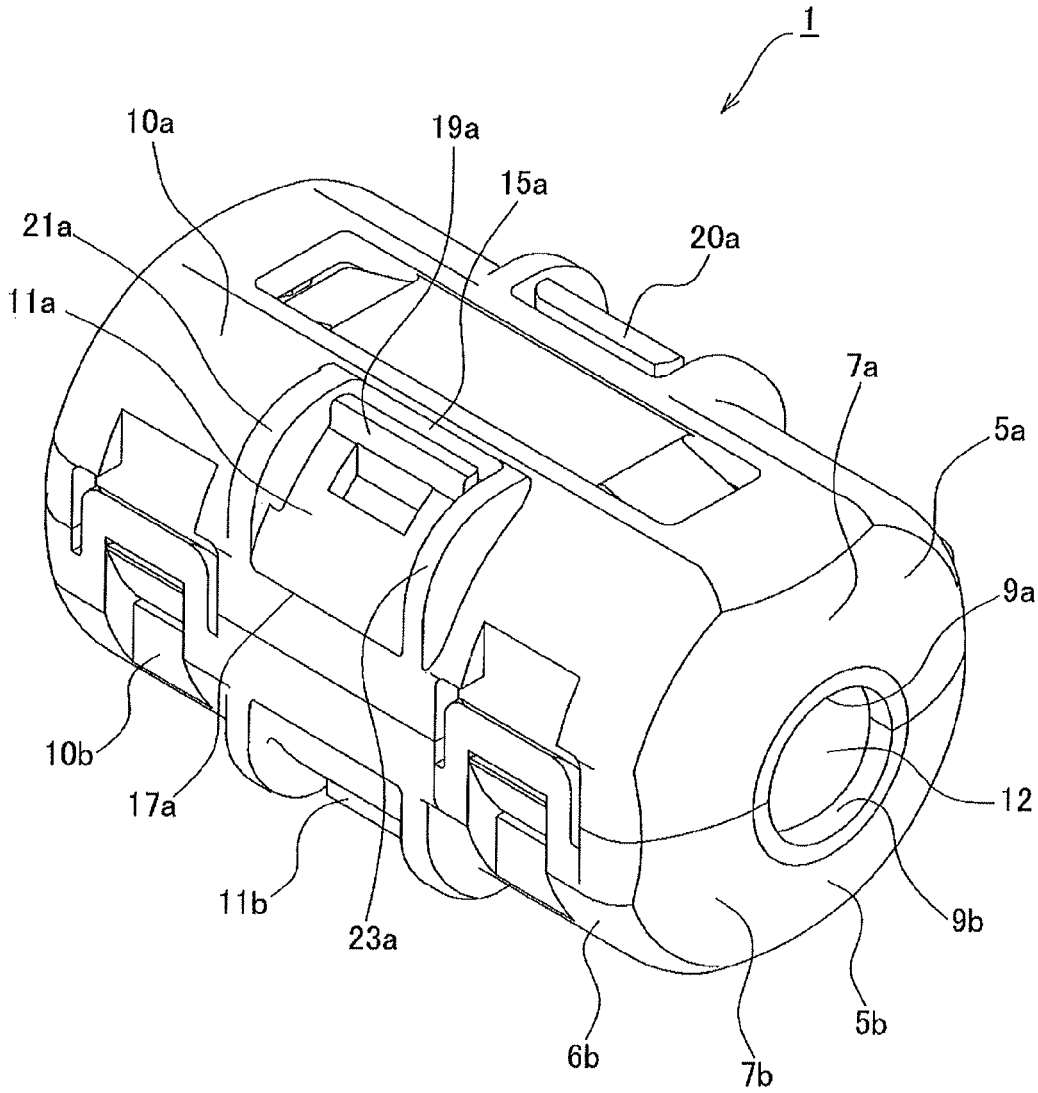
FIG. 1 is a perspective view of an entire ferrite clamp 1.

1 . . . ferrite clamp, 3*a*, 3*b* . . . divided core, 5*a*, 5*b* . . . case part, 6*a*, 6*b* . . . projection, 7*a*, 7*b* . . . side wall portion, 8*a*, 8*b* . . . groove, 9*a* . . . opening, 10*a*, 10*b* . . . outer peripheral surface, 11*a*, 13*a*, 11*b*, 13*b* . . . elastically deformable portion, 12 . . . through hole, 15*a* . . . cutout, 17*a* . . . connection side, 19*a*, 20*a*, 19*b*, 20*b* . . . protruding portion, 21*a*, 23*a* . . . guide plate, 25 . . . insertion hole, 27 . . . magnetic core, 29 . . . electric cable, 31 . . . clamping band, 33*a* . . . sloping portion, 35*a* . . . flat portion, 37*a* . . . end portion, 39*a* . . . protruding portion, 41*a* . . . protruding portion, 43*a* . . . band insertion hole, P1, P3 . . . case part, P5 . . . clamping band, P7 . . . locking member

MODE FOR CARRYING OUT THE INVENTION

First Embodiment

1. Configuration of Ferrite Clamp 1

A configuration of a ferrite clamp 1 will be described based on FIG. 1 to FIG. 3.

The ferrite clamp 1 includes a pair of divided cores 3*a* and 3*b*, each of which has an open circular shape, and a pair of case parts 5*a* and 5*b* to hold divided cores 3*a* and 3*b*, respectively.

The case parts 5*a* and 5*b* as a whole form a case having a cylindrical shape. The case parts 5*a* and 5*b* are formed of thin members. An elastic resin is employed for the members. Also, the case parts 5*a* and 5*b* are formed such that the case having the cylindrical shape can be divided along a plane including a central axis of the cylindrical shape.

Divided cores 3*a* and 3*b* are fit in the case parts 5*a* and 5*b*, respectively. Projections 6*a* and 6*b* are formed in respective inner peripheral surfaces of the respective case parts 5*a* and 5*b*. In respective outer peripheral surfaces of the divided cores 3*a* and 3*b*, there are provided grooves 8*a* and 8*b* corresponding respectively to the projections 6*a* and 6*b* of the case parts 5*a* and 5*b*. When fitting the divided core 3*a* in the case part 5*a*, the projection 6*a* and the groove 8*a* are engaged with each other, to thereby stabilize a position of the divided core 3*a*. Also, when fitting the divided core 3*b* in the case part 5*b*, the projection 6*b* and the groove 8*b* are engaged with each other, to thereby stabilize a position of the divided core 3*b*.

At both ends of the case parts 5*a* and 5*b* in an axial direction (i.e., in a direction perpendicular to a paper surface of FIG. 2 or FIG. 3), there are provided side wall portions 7*a* and 7*b* perpendicular to the axial direction. The side wall portions 7*a* and 7*b* are provided with semicircular openings 9*a* and 9*b*, respectively. The openings 9*a* and 9*b* constitute a substantially circular through hole 12 when the case parts 5*a* and 5*b* are closed as shown in FIG. 1.

Elastically deformable portions 11*a* and 13*a* are provided in an outer peripheral surface 10*a* of the case part 5*a*. The outer peripheral surface 10*a* is a portion to hold the outer peripheral surface of the divided core 3*a*. Elastically deformable portions 11*b* and 13*b* are provided in an outer peripheral surface 10*b* of the case part 5*b*. The outer peripheral surface 10*b* is a portion to hold the outer peripheral surface of the divided core 3*b*. The elastically deformable portions 11*a*, 13*a*, 11*b*, and 13*b* have an essentially same configuration. Here, the configuration will be described taking the elastically deformable portion 11*a* as an example.

The elastically deformable portion 11*a* is formed by providing a substantially U-shaped cutout 15*a* in the case part 5*a*. That is, a portion defined by the cutout 15*a* constitutes the elastically deformable portion 11*a*. The elastically deformable portion 11*a* is connected to a main body of the case part 5*a* only at a connecting side 17*a* thereof. The elastically deformable portion 11*a* as a whole has a plate-like shape and is deflectable. The connecting side 17*a* is parallel to a longitudinal central axis of the case part 5*a*. Also, the connecting side 17*a* is located closer to an abutting region between the case part 5*a* and the case part 5*b* than the cutout 15*a*. At an opposite side to the connecting side 17*a* of the elastically deformable portion 11*a*, there is formed a protruding portion 19*a* having an outwardly convex shape. In a cross-section shown in FIG. 3, the protruding portion 19*a* is located between a top of the case part 5*a* (an uppermost part in FIG. 3) and a portion of the case part 5*a* abutting the case part 5*b*.

When the protruding portion 19*a* is pressed inwardly from outside of the case part 5*a*, the elastically deformable portion 11*a* is pushed into the case part 5*a* (elastically deformed). The protruding portion 19*a* has such a size that the protruding portion 19*a* enters into teeth-like convexes and concaves provided in a below described clamping band 31 and is caught by the convexes and concaves. The elastically deformable portions 13*a*, 11*b*, and 13*b* are also formed in a same manner as the elastically deformable portion 11*a*. The elastically deformable portions 13*a*, 11*b*, and 13*b* include protruding portions 20*a*, 19*b*, and 20*b*, respectively, which are the same as the protruding portion 19*a*.

The case part 5*a* also includes a pair of guide plates 21*a* and 23*a* standing so as to sandwich the connecting side 17*a* and the protruding portion 19*a* of the elastically deformable portion 11*a* from both sides thereof.

Figure 2:
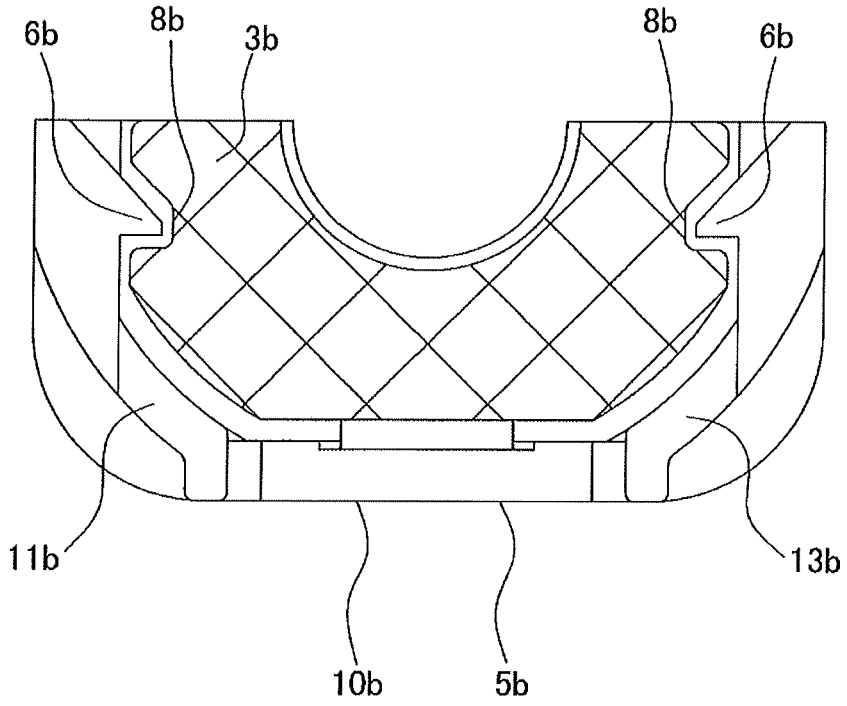
FIG. 2 is a side cross-sectional view showing a case part 5*a* and a divided core 3*a*.
Figure 3:
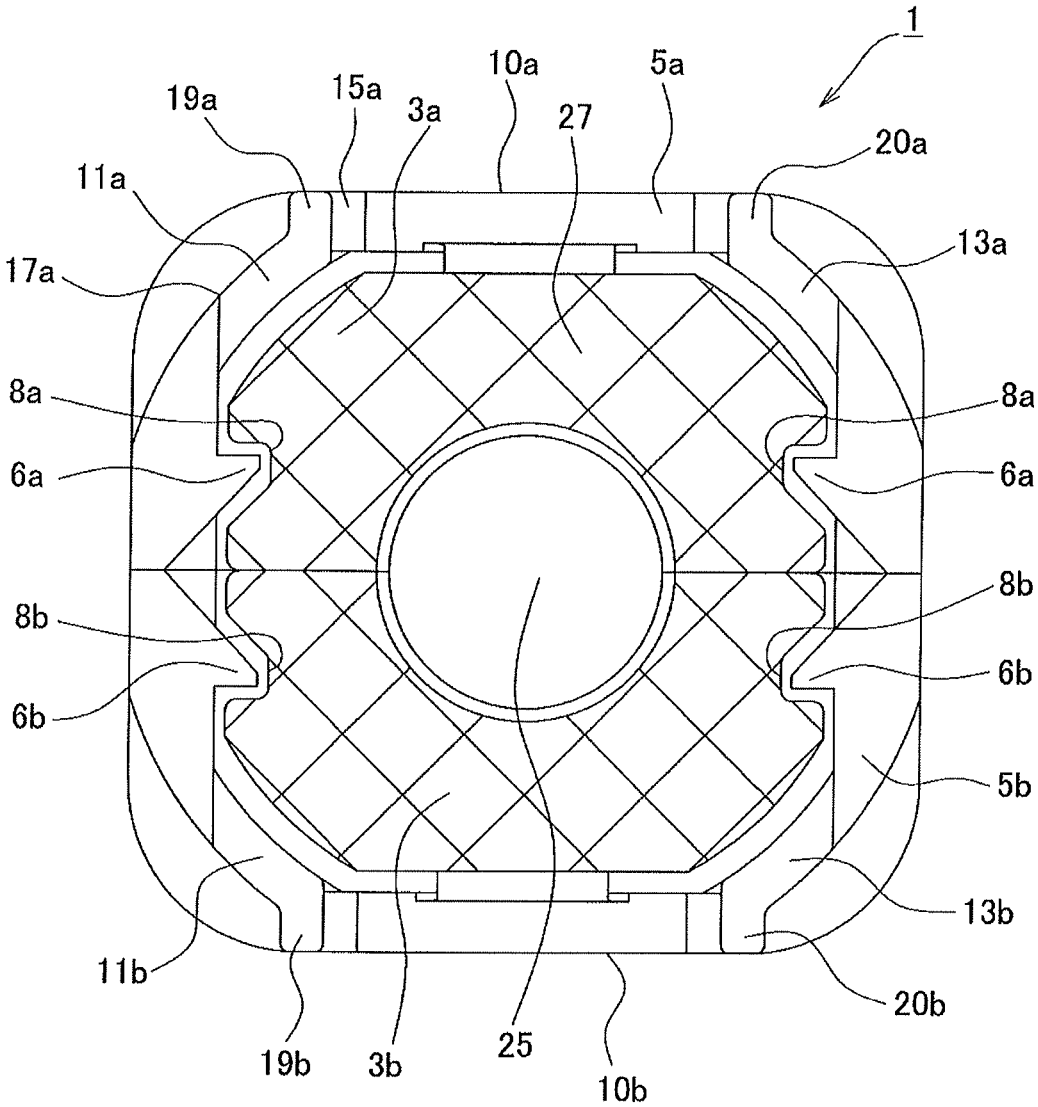
FIG. 3 is a side cross-sectional view of the ferrite clamp 1.

As shown in FIG. 1 and FIG. 3, when the case part 5*a* holding the divided core 3*a* and the case part 5*b* holding the divided core 3*b* are fit together, the divided cores 3*a* and 3*b* constitute a circular magnetic core 27 having an insertion hole 25 for inserting an electric cable therethrough. Also, the case parts 5*a* and 5*b* constitute an integrated case, which contains thereinside the magnetic core 27. The insertion hole 25 of the magnetic core 27 and the through hole 12 formed by the case parts 5*a* and 5*b* are coaxially aligned. Then, it is possible to insert an electric cable through the insertion hole 25 and the through hole 12.

A material for the divided cores 3*a* and 3*b* is a publicly known ferrite. The divided cores 3*a* and 3*b* may be formed into the aforementioned configuration by means of a publicly known forming method.

2. Method for Use of Ferrite Clamp 1

A method for use of a ferrite clamp 1 will now be described based on FIG. 4A to FIG. 4B.

Figure 4A:
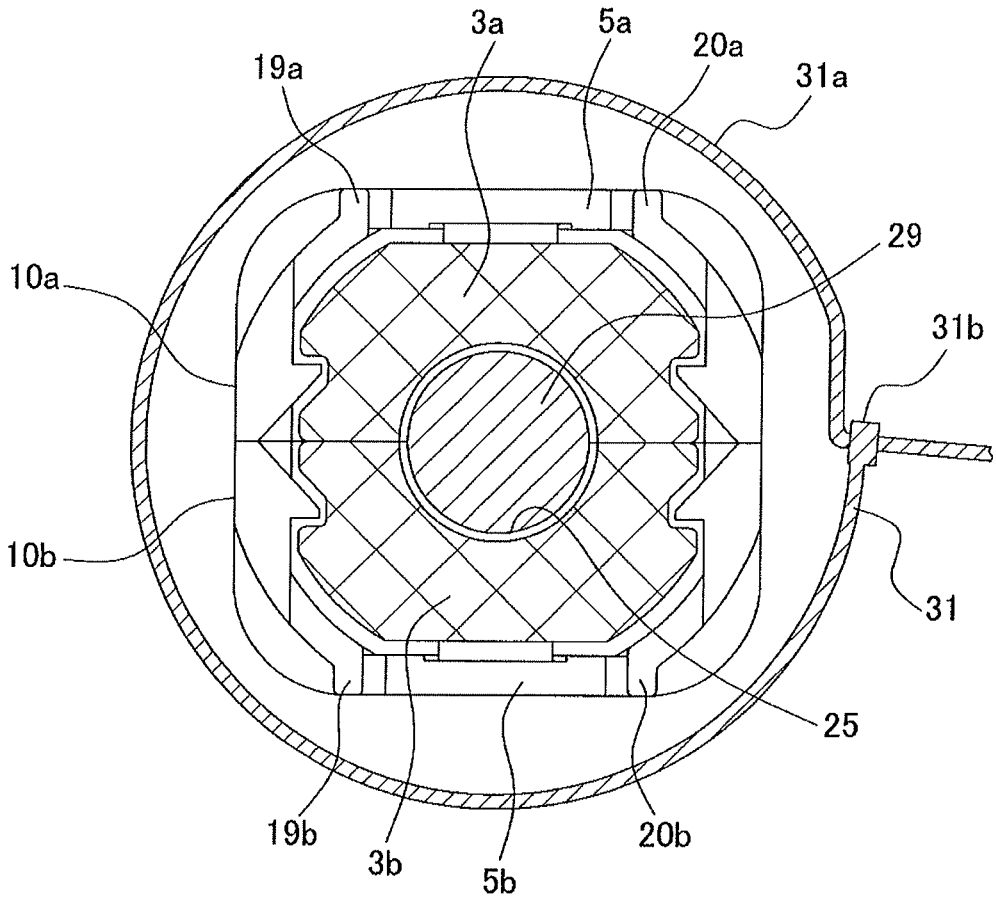
FIG. 4A is an explanatory view showing a method for tightening the ferrite clamp 1 with a clamping band 31 and also showing a state where the ferrite clamp 1 has not yet been tightened with the clamping band 31.

The ferrite clamp 1 is first assembled from a state where the case part 5*a* holding the divided core 3*a* and the case part 5*b* holding the divided core 3*b* are separated into a state shown in FIG. 4A.

Specifically, the case parts 5*a* and 5*b* are fit together such that an electric cable 29 passes through the insertion hole 25. Then, the clamping band 31 is wound so as to go around along the outer peripheral surface 10*a* of the case part 5*a* as well as the outer peripheral surface 10*b* of the case part 5*b*.

Figure 4B:
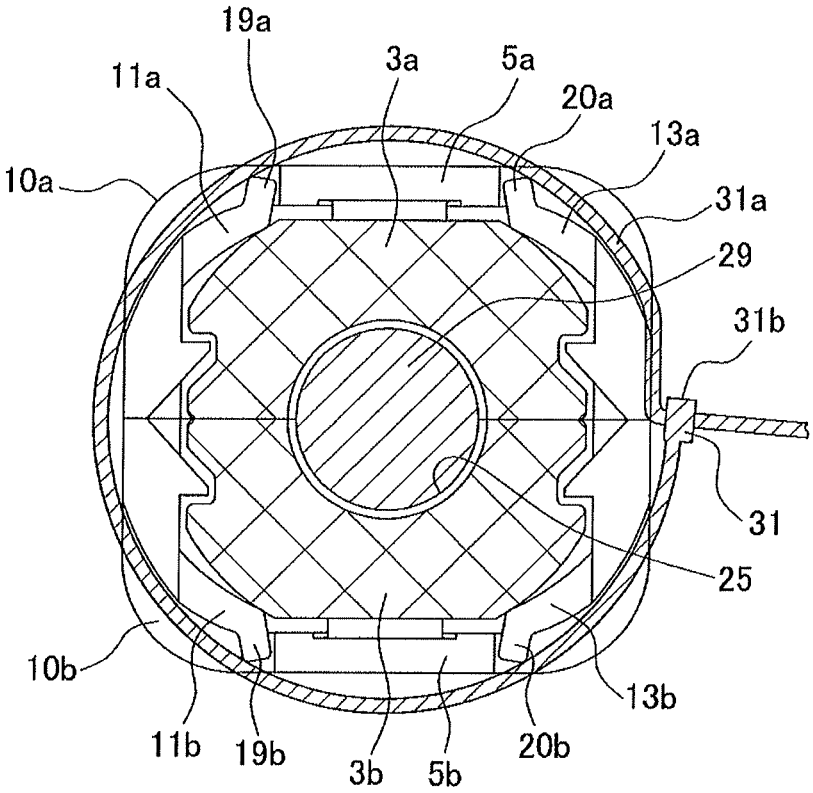
FIG. 4B is an explanatory view showing the method for tightening the ferrite clamp 1 with the clamping band 31 and also showing a state where the ferrite clamp 1 has been tightened with the clamping band 31.

Subsequently, as shown in FIG. 4B, a loop of the clamping band 31 is tightened. Specifically, the case parts 5*a* and 5*b* are tightened from outside thereof with the clamping band 31. In this case, a path of the clamping band 31 is a path which passes over the elastically deformable portions 11*a*, 13*a*, 11*b*, and 13*b*, and goes around the outer peripheral surface 10*a* of the case part 5*a* as well as the outer peripheral surface 10*b* of the case part 5*b*. Also, the clamping band 31 may be arranged so as to pass between the pair of guide plates (the guide plates 21*a* and 23*a* with respect to the elastically deformable portion 11*a*) provided on respective both sides of the elastically deformable portions 11*a*, 13*a*, 11*b*, and 13*b*.

The clamping band 31 is a well-known one which is also referred to as a cable tie or a nylon tie. Examples of the clamping band 31 include products named Ty-Rap (Registered Trademark) and INSULOK (Registered Trademark). The clamping band 31 includes a belt-like band 31*a* and a locking member 31*b* provided at one end of the band 31*a*. As the other end (an end without the locking member) of the band 31*a* is inserted through the locking member 31*b*, the loop formed by the band 31*a* can be tightened. A surface of the band 31*a* includes the teeth-like convexes and concaves (not shown) formed in a large number at predetermined intervals along a longitudinal direction of the band 31*a*. The teeth-like convexes and concaves are adapted to prevent the band 31*a* that has passed the locking member 31*b* from returning in a reverse direction.

When the case parts 5*a* and 5*b* are tightened by the clamping band 31, the protruding portion 19*a* of the elastically deformable portion 11*a* is pushed inwardly by a tightening force of the clamping band 31 as shown in FIG. 4B. Then, the elastically deformable portion 11*a* is elastically deformed inwardly and abuts the divided core 3*a*, to thereby push the divided core 3*a* toward the divided core 3*b*. In a same manner, the elastically deformable portion 13*a* is elastically deformed inwardly by the tightening force by the clamping band 31 and abuts the divided core 3*a*, to thereby push the divided core 3*a* toward the divided core 3*b*. Also, the elastically deformable portions 11*b* and 13*b* are elastically deformed inwardly by the tightening force by the clamping band 31 and abut the divided core 3*b*, to thereby push the divided core 3*b* toward the divided core 3*a*.

3. Advantages Realized by Ferrite Clamp 1

(1) The ferrite clamp 1 includes the protruding portions 19*a*, 20*a*, 19*b*, and 20*b*, each having an outwardly convex shape, in the outer peripheral surfaces 10*a* and 10*b* of the case parts 5*a* and 5*b*. When the case parts 5*a* and 5*b* are tightened by the clamping band 31, the protruding portions 19*a*, 20*a*, 19*b*, and 20*b* are engaged with the teeth-like convexes and concaves formed in the clamping band 31. As a result, when tightening the clamping band 31, the clamping band 31 is suppressed from sliding and rotating on the outer peripheral surfaces 10*a* and 10*b* of the case parts 5*a* and 5*b*, and thus an improved workability can be achieved.

(2) When the case parts 5*a* and 5*b* are tightened by the clamping band 31, the elastically deformable portion 11*a* and the elastically deformable portion 13*a* are pushed inwardly, to thereby push the divided core 3*a* toward the divided core 3*b* as shown in FIG. 4B. Also, the elastically deformable portion 11*b* and the elastically deformable portion 13*b* are pushed inwardly, to thereby push the divided core 3*b* toward the divided core 3*a*. As a result, a joining pressure between the divided cores 3*a* and 3*b* is maintained, and a long-term reliability can be ensured.

In addition, since the joining pressure between the divided cores 3*a* and 3*b* can be maintained by means of the aforementioned mechanism, it is not necessarily required to provide, inside the case parts 5*a* and 5*b*, some spring mechanism (such as a resin spring, a metal spring, and the like) that generates a force to to thereby push the divided cores 3*a* and 3*b* against each other. Even in case of providing a spring mechanism, the spring mechanism need not have a high spring pressure. As a result, only a small force is required to close the case parts 5*a* and 5*b* against the spring pressure of the spring mechanism when fitting the case parts 5*a* and 5*b* together.

Second Embodiment

1. Configuration of Ferrite Clamp 1 and Method for Use Thereof

The ferrite clamp 1 in a second embodiment has essentially the same configuration as the ferrite clamp 1 in the first embodiment. However, the ferrite clamps 1 in these two embodiments are different in terms of configurations of the elastically deformable portions 11*a*, 13*a*, 11*b*, and 13*b*. The following description will focus mainly on the differences, and explanations of the same portions as in the above-described embodiment will be omitted or simplified.

Figure 5:
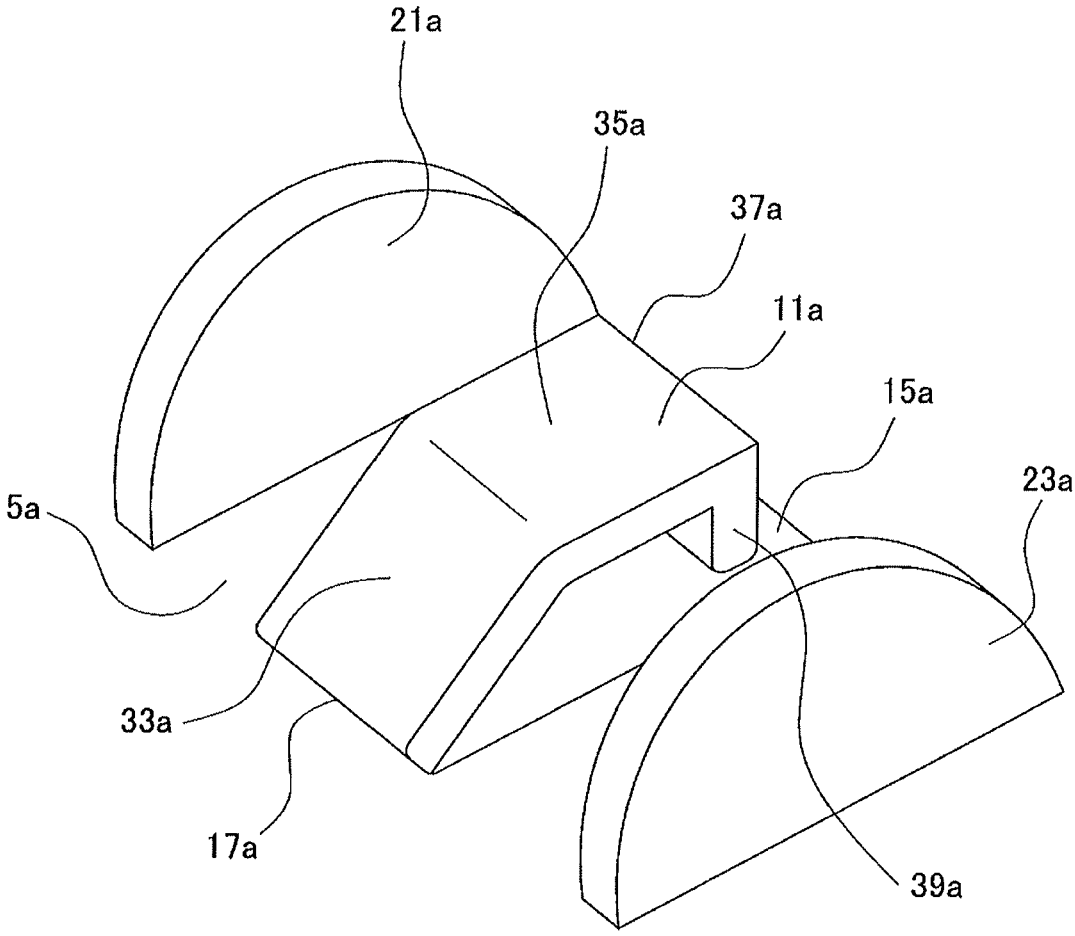
FIG. 5 is a perspective view showing an elastically deformable portion 11*a*.

The configuration of the elastically deformable portion 11*a* in the second embodiment will be described based on FIG. 5. The elastically deformable portions 13*a*, 11*b*, and 13*b* have the same configuration as the elastically deformable portion 11*a*. Also, locations at which the elastically deformable portions 11*a*, 13*a*, 11*b*, and 13*b* are provided are the same as in the first embodiment.

The elastically deformable portion 11*a* is formed by providing a substantially U-shaped cutout 15*a* in the case part 5*a*. That is, a portion defined by the cutout 15*a* constitutes the elastically deformable portion 11*a*. The elastically deformable portion 11*a* is connected to the main body of the case part 5*a* only at the connecting side 17*a*. The elastically deformable portion 11*a* as a whole has a plate-like shape and is deflectable. The connecting side 17*a* is parallel to the longitudinal central axis of the case part 5*a*. Also, the connecting side 17*a* is located closer to the abutting region between the case part 5*a* and the case part 5*b* than the cutout 15*a*. The elastically deformable portion 11*a* includes the sloping portion 33*a* and the flat portion 35*a*. The sloping portion 33*a* is a portion of the elastically deformable portion 11*a* configured to gradually depart from the case part 5*a* beginning at the connecting side 17*a*. The flat portion 35*a* is a portion formed in a flat manner and in connection with the sloping portion 33*a*. The flat portion 35*a* is arranged at a position extending outwardly from the case part 5*a*. An end portion 37*a* of the flat portion 35*a* located opposite to the connecting side 17*a* forms an acute corner and is engageable with the teeth-like convexes and concaves formed in the clamping band 31. At the end portion 37*a* on a reverse side of the flat portion 35*a*, a protruding portion 39*a* protruding downwardly is formed. When the flat portion 35*a* is pressed inwardly by a tightening force by the clamping band 31, the elastically deformable portion 11*a* is pushed into the case part 5*a* (elastically deformed). Then, the protruding portion 39*a* to thereby pushes the divided core 3*a* toward the divided core 3*b*. The elastically deformable portion 13*a*, 11*b*, and 13*b* are also configured in the same manner as the elastically deformable portion 11*a*.

The case part 5*a* also includes the pair of guide plates 21*a* and 23*a* standing so as to sandwich the elastically deformable portion 11*a* from both sides thereof. The guide plates 21*a* and 23*a* guide the clamping band 31 such that the clamping band 31 passes over the elastically deformable portion 11*a*.

2. Advantages Realized by Ferrite Clamp 1

(1) The ferrite clamp 1 includes the end portion 37*a* of the elastically deformable portion 11*a* in the outer peripheral surfaces 10*a* and 10*b* of the case parts 5*a* and 5*b*. Also included are not-shown end portions, which are the same as the end portion 37*a*, provided in the elastically deformable portions 13*a*, 11*b*, and 13*b*. Hereinafter, such end portions are also referred to as end portions of the elastically deformable portions 13*a*, 11*b*, and 13*b*.

When tightening the case parts 5*a* and 5*b* by the clamping band 31, the end portions of the elastically deformable portions 11*a*, 13*a*, 11*b* and 13*b* become engaged with the teeth-like convexes and concaves formed in the clamping band 31. As a result, when tightening the clamping band 31, the clamping band 31 is suppressed from sliding and rotating on the outer peripheral surfaces 10*a* and 10*b* of the case parts 5*a* and 5*b*, and thus an improved workability can be achieved.

(2) When the case parts 5*a* and 5*b* are tightened by the clamping band 31, the elastically deformable portion 11*a* and the elastically deformable portion 13*a* are pushed inwardly, to thereby push the divided core 3*a* toward the divided core 3*b*. Also, the elastically deformable portion 11*b* and the elastically deformable portion 13*b* are pushed inwardly, to thereby push the divided core 3*b* toward the divided core 3*a*. As a result, a joining pressure between the divided cores 3*a* and 3*b* is maintained, and a long-term reliability can be ensured.

In addition, since the joining pressure between the divided cores 3*a* and 3*b* can be maintained by means of the aforementioned mechanism, it is not necessarily required to provide, inside the case parts 5*a* and 5*b*, some spring mechanism that generates a force to thereby push the divided cores 3*a* and 3*b* against each other. Even in case of providing a spring mechanism, the spring mechanism need not have a high spring pressure. As a result, only a small force is required to close the case parts 5*a* and 5*b* against the spring pressure of the spring mechanism when fitting the case parts 5*a* and 5*b* together.

Third Embodiment

1. Configuration of Ferrite Clamp 1 and Method for Use Thereof

The ferrite clamp 1 in a third embodiment has essentially the same configuration as the ferrite clamp 1 in the first embodiment. However, the ferrite clamps 1 in these two embodiments are different in terms of configurations of the elastically deformable portions 11*a*, 13*a*, 11*b*, and 13*b*. The following description will focus mainly on the differences, and explanations of the same portions as in the above-described embodiment will be omitted or simplified.

Figure 6:
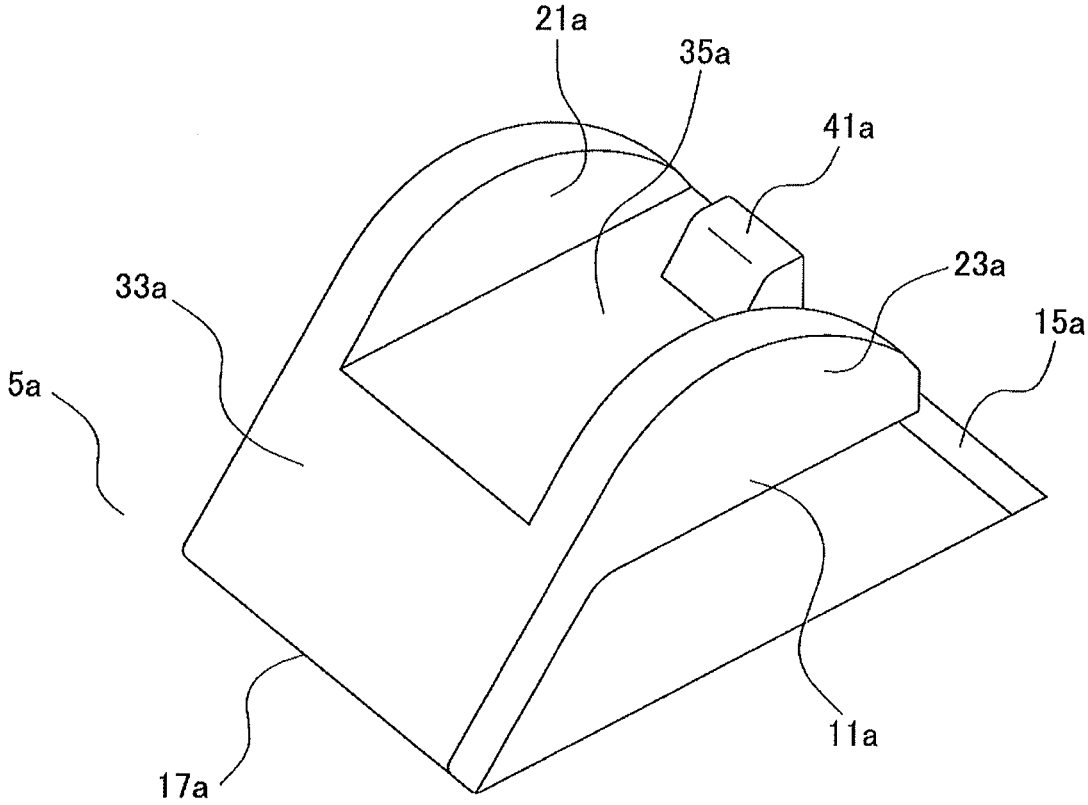
FIG. 6 is a perspective view showing an elastically deformable portion 11*a*.

The configuration of the elastically deformable portion 11*a* in the third embodiment will be described based on FIG. 6.

The elastically deformable portions 13*a*, 11*b*, and 13*b* have the same configuration as the elastically deformable portion 11*a*. Also, locations at which the elastically deformable portions 11*a*, 13*a*, 11*b*, and 13*b* are provided are the same as in the first embodiment.

The elastically deformable portion 11*a* is formed by providing a substantially U-shaped cutout 15*a* in the case part 5*a*. That is, a portion defined by the cutout 15*a* constitutes the elastically deformable portion 11*a*. The elastically deformable portion 11*a* is connected to the main body of the case part 5*a* only at the connecting side 17*a*. The connecting side 17*a* is parallel to the longitudinal central axis of the case part 5*a*. Also, the connecting side 17*a* is located closer to the abutting region between the case part 5*a* and the case part 5*b* than the cutout 15*a*. The elastically deformable portion 11*a* includes the sloping portion 33*a* and the flat portion 35*a*. The sloping portion 33*a* is a portion of the elastically deformable portion 11*a* configured to gradually depart from the case part 5*a* beginning at the connecting side 17*a*. The flat portion 35*a* is a portion formed in a flat manner and in connection with the sloping portion 33*a*. The flat portion 35*a* is arranged at a position extending outwardly from the case part 5*a*. At an end portion of the flat portion 35*a* opposite to the connecting side 17*a*, a protruding portion 41*a* which is outwardly convex is formed. When the protruding portion 41*a* is pressed inwardly from outside, the elastically deformable portion 11*a* is pushed into the case part 5*a* (elastically deformed). The protruding portion 41*a* has such a size that the protruding portion 41*a* enters into teeth-like convexes and concaves formed in the clamping band 31 and is caught by the convexes and concaves. The elastically deformable portions 13*a*, 11*b*, and 13*b* are also formed in the same manner as the elastically deformable portion 11*a*. In the third embodiment, the guide plates 21*a* and 23*a* are provided on both sides of the flat portion 35*a*. The guide plates 21*a* and 23*a* sandwich the clamping band 31 passing over the flat portion 35*a* from both sides thereof, and guide the clamping band 31.

When the flat portion 35*a* is pushed inwardly with the clamping band 31, the elastically deformable portion 11*a* is elastically deformed and pushed into the case part 5*a*, pushing the divided core 3*a* toward the divided core 3*b*. The elastically deformable portions 13*a*, 11*b*, and 13*b* are also configured in the same manner as the elastically deformable portion 11*a*.

2. Advantages Realized by the Ferrite Clamp 1

(1) The ferrite clamp 1 includes the protruding portion 41*a* of the elastically deformable portion 11*a* in the outer peripheral surfaces 10*a* and 10*b* of the case parts 5*a* and 5*b*. Also included are not-shown protruding portions, which are the same as the protruding portion 41, provided in the elastically deformable portion 13*a*, 11*b*, and 13*b*. Hereinafter, such protruding portions are also referred to as protruding portions of the elastically deformable portions 13*a*, 11*b*, and 13*b*.

When tightening the case parts 5*a* and 5*b* by the clamping band 31, the end portions of the elastically deformable portions 11*a*, 13*a*, 11*b* and 13*b* become engaged with the teeth-like convexes and concaves formed in the clamping band 31. As a result, when tightening the clamping band 31, the clamping band 31 is suppressed from sliding and rotating on the outer peripheral surfaces 10*a* and 10*b* of the case parts 5*a* and 5*b*, and thus an improved workability can be achieved.

(2) When the case parts 5*a* and 5*b* are tightened by the clamping band 31, the elastically deformable portion 11*a* and the elastically deformable portion 13*a* are pushed inwardly, to thereby push the divided core 3*a* toward the divided core 3*b*. Also, the elastically deformable portion 11*b* and the elastically deformable portion 13*b* are pushed inwardly, to thereby push the divided core 3*b* toward the divided core 3*a*. As a result, a joining pressure between the divided cores 3*a* and 3*b* is maintained, and a long-term reliability can be ensured.

In addition, since the joining pressure between the divided cores 3*a* and 3*b* can be maintained by means of the aforementioned mechanism, it is not necessarily required to provide, inside the case parts 5*a* and 5*b*, some spring mechanism that generates a force to press the divided cores 3*a* and 3*b* against each other. Even in case of providing a spring mechanism, the spring mechanism need not have a high spring pressure. As a result, only a small force is required to close the case parts 5*a* and 5*b* against the spring pressure of the spring mechanism when fitting the case parts 5*a* and 5*b* together.

Fourth Embodiment

1. Configuration of Ferrite Clamp 1 and Method for Use Thereof

The ferrite clamp 1 in a fourth embodiment has essentially the same configuration as the ferrite clamp 1 in the first embodiment. However, the ferrite clamps 1 in these two embodiments are different in terms of configurations of the elastically deformable portions 11*a*, 13*a*, 11*b*, and 13*b*. The following description will focus mainly on the differences, and explanations of the same portions as in the above-described embodiment will be omitted or simplified.

Figure 7:
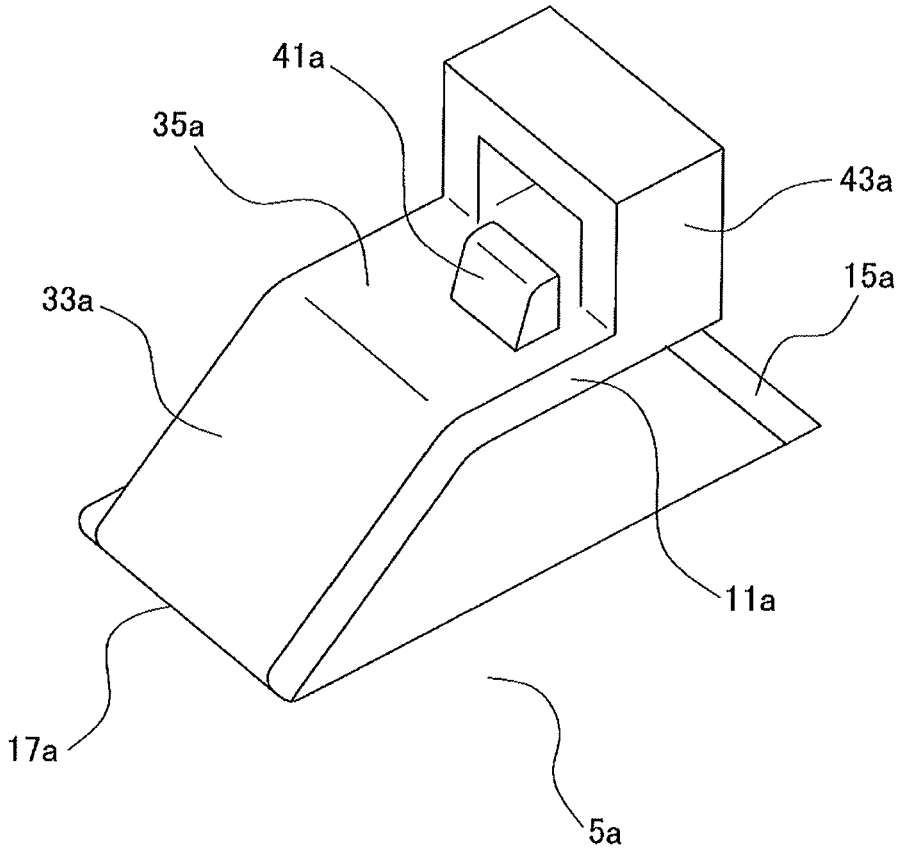
FIG. 7 is a perspective view showing an elastically deformable portion 11*a*.
Figure 8:
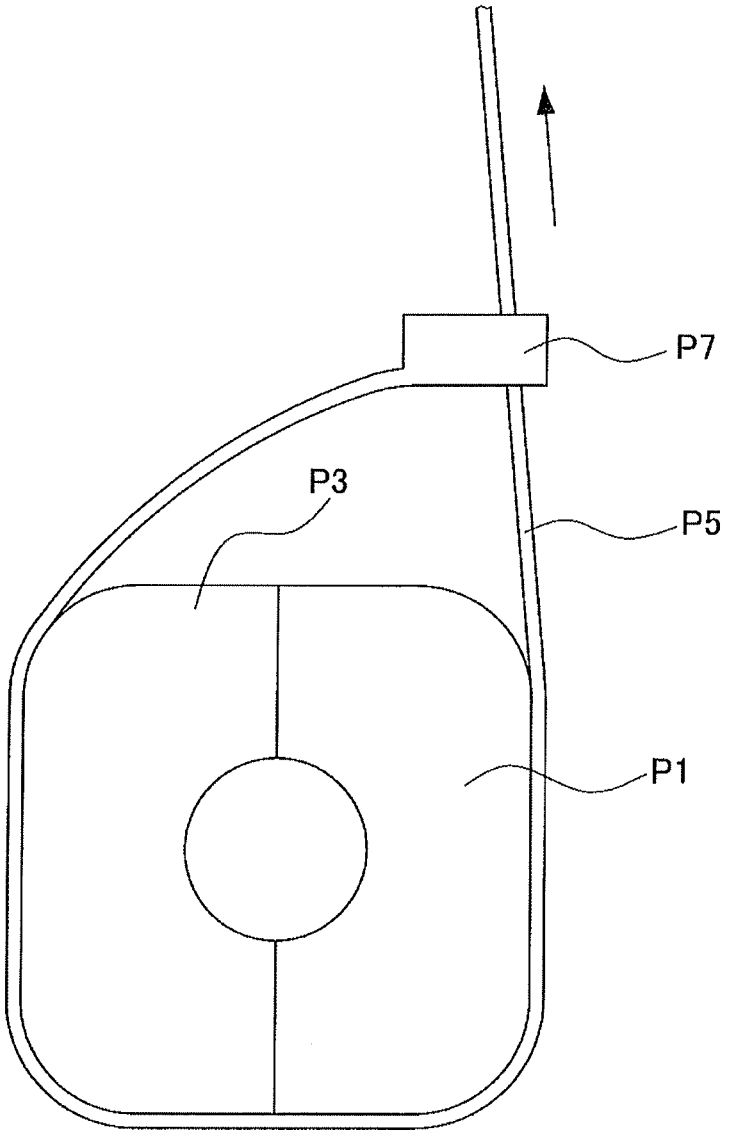
FIG. 8 is an explanatory view showing a method for securing a conventional ferrite clamp.

The configuration of the elastically deformable portion 11*a* in the fourth embodiment will be described based on FIG. 7. The elastically deformable portions 13*a*, 11*b*, and 13*b* have the same configuration as the elastically deformable portion 11*a*. Also, locations at which the elastically deformable portions 11*a*, 13*a*, 11*b*, and 13*b* are provided are the same as in the first embodiment.

The elastically deformable portion 11*a* is formed by providing a substantially U-shaped cutout 15*a* in the case part 5*a*. That is, a portion defined by the cutout 15*a* constitutes the elastically deformable portion 11*a*. The elastically deformable portion 11*a* is connected to the main body of the case part 5*a* only at the connecting side 17*a*. The connecting side 17*a* is parallel to the longitudinal central axis of the case part 5*a*. Also, the connecting side 17*a* is located closer to the abutting region between the case part 5*a* and the case part 5*b* than the cutout 15*a*. The elastically deformable portion 11*a* includes the sloping portion 33*a* and the flat portion 35*a*. The sloping portion 33*a* is a portion of the elastically deformable portion 11*a* configured to gradually depart from the case part 5*a* beginning at the connecting side 17*a*. The flat portion 35*a* is a portion formed in a flat manner and in connection with the sloping portion 33*a*. The flat portion 35*a* is arranged at a position extending outwardly from the case part 5*a*. In a vicinity of a center of the flat portion 35*a*, a protruding portion 41*a* which is outwardly convex is formed. When the protruding portion 41*a* is pressed inwardly from outside, the elastically deformable portion 11*a* is elastically deformed and is pushed into the case part 5*a*. The protruding portion 41*a* has such a size that the protruding portion 41*a* enters into teeth-like convexes and concaves formed in the clamping band 31 and is caught by the convexes and concaves. At an end portion of the flat portion 35*a* located opposite to the sloping portion 33*a*, a band insertion hole 43*a* having a gate-like shape is formed. The band insertion hole 43*a* is adapted to insert therethrough the clamping band 31, which passes over the flat portion 35*a*, to thereby guide the clamping band 31.

When the flat portion 35*a* is pressed inwardly from outside by the clamping band 31, the elastically deformable portion

11*a* is elastically deformed and pushed into the case part 5*a*, to thereby push the divided core 3*a* toward the divided core 3*b*. The elastically deformable portion 13*a*, 11*b*, and 13*b* are also configured in the same manner as the elastically deformable portion 11*a*.

2. Advantages Realized by the Ferrite Clamp 1

(1) The ferrite clamp 1 includes the protruding portion 41*a* of the elastically deformable portion 11*a* in the outer peripheral surfaces 10*a* and 10*b* of the case parts 5*a* and 5*b*. Also included are not-shown protruding portions, which are the same as the protruding portion 41, in the elastically deformable portion 13*a*, 11*b*, and 13*b*. Hereinafter, such protruding portions are also referred to as the protruding portions of the elastically deformable portions 13*a*, 11*b*, and 13*b*.

When tightening the case parts 5*a* and 5*b* by the clamping band 31, the protruding portions of the elastically deformable portions 11*a*, 13*a*, 11*b* and 13*b* become engaged with the teeth-like convexes and concaves formed in the clamping band 31. As a result, when tightening the clamping band 31, the clamping band 31 is suppressed from sliding and rotating on the outer peripheral surfaces 10*a* and 10*b* of the case parts 5*a* and 5*b*, and thus an improved workability can be achieved.

(2) When the case parts 5*a* and 5*b* are tightened by the clamping band 31, the elastically deformable portion 11*a* and the elastically deformable portion 13*a* are pushed inwardly, to thereby push the divided core 3*a* toward the divided core 3*b*. Also, the elastically deformable portion 11*b* and the elastically deformable portion 13*b* are pushed inwardly, to thereby push the divided core 3*b* toward the divided core 3*a*. As a result, a joining pressure between the divided cores 3*a* and 3*b* is maintained, and a long-term reliability can be ensured.

Further, since the joining pressure between the divided cores 3*a* and 3*b* can be maintained by means of the aforementioned mechanism, it is not necessarily required to provide, inside the case parts 5*a* and 5*b*, some spring mechanism that generates a force to press the divided cores 3*a* and 3*b* against each other. Even in case of providing a spring mechanism, the spring mechanism need not have a high spring pressure. As a result, only a small force is required to close the case parts 5*a* and 5*b* against the spring pressure of the spring mechanism when fitting the case parts 5*a* and 5*b* together.

It is needless to say that the present invention should not be limited to the above described embodiments, but may be practiced in various forms within the scope not departing from the present invention.

For example, the elastically deformable portion may be provided in only one of the case parts 5*a* and 5*b*.

Also, the number of the elastically deformable portions provided in the case part 5*a* is not limited to two, but may be, for example, one, three, five, etc. The same is applicable to the case part 5*b*.

Moreover, the case parts 5*a* and 5*b* may be completely separable from each other, or may be joined with a hinge to be openable and closable.

The invention claimed is:

1. A ferrite clamp comprising:

a pair of divided cores, each being formed in an open circular shape; and a pair of case parts, each being adapted to hold each of the divided cores, wherein when the case parts are assembled with each other, the pair of divided cores held by the case parts constitute a circular magnetic core having an insertion hole for inserting an electric cable therethrough, the case part Includes, in a portion thereof to hold an outer peripheral surface of the divided core, an elastically deformable portion which protrudes outwardly relative to a surrounding area and is inwardly elastically deformable, and the elastically deformable portion, when elastically deformed inwardly relative to the case part by a clamping band which applies an inwardly directed pressing force on the elastically deformable portion, pushes one of the divided cores toward the other one of the divided cores.

2. The ferrite clamp according to claim 1, wherein the elastically deformable portion includes, in an outer peripheral surface thereof, a protruding portion which is outwardly convex.

3. The ferrite clamp according to claim 1, further comprising, in an outer peripheral surface of the case part, a guide portion to guide the clamping band at a path passing over the elastically deformable portion.

4. The ferrite clamp according to claim 2, further comprising, in an outer peripheral surface of the case part, a guide portion to guide the clamping band at a path passing over the elastically deformable portion.

5. The ferrite clamp according to claim 1, wherein the ferrite clamp further comprises the clamping band which engages with each of the elastically deformable portions and elastically deforms the elastically deformable portions inwardly relative to the case part so that the elastically deformable portions bias the divided cores toward and into engagement with one another.

6. The ferrite clamp according to claim 5, wherein a pair of guide portions extend radially outwardly from an outer surface of the case part on adjacent opposed sides of each elastically deformable portion for facilitating engagement between the clamping band and the elastically deformable portion.

7. The ferrite clamp according to claim 1, wherein each case part has at least two elastically deformable portions which are circumferentially spaced from one another.

8. The ferrite clamp according to claim 7, wherein the at least two elastically deformable portions of each case part, when in a relaxed un-biased state free from the inwardly directed pressing force applied by the clamping band, are spaced from the divided core accommodated by the respective case part.

9. The ferrite clamp according to claim 1, wherein each case part has two elastically deformable portions which are circumferentially spaced from one another so that, when the case parts are assembled with one another, the four elastically deformable portions are equally spaced circumferentially about the assembled case parts.

10. The ferrite clamp according to claim 1, wherein a plurality of radially inward projections are disposed on an inner surface of each case part and each of the radially inward projections is located to engage with a corresponding groove in the divided core accommodated by the respective case part.

11. The ferrite clamp according to claim 1, wherein at least two guide portions extend radially outwardly from an outer peripheral surface of each elastically deformable portion.

12. The ferrite clamp according to claim 1, wherein an inwardly protruding portion protrudes radially inwardly from each elastically deformable portion.

13. A ferrite clamp comprising:

a pair of divided cores, each being formed in an open circular shape; and a pair of case parts, each being adapted to hold each of the divided cores, wherein when the case parts are assembled with each other, the pair of divided cores held by the case parts constitute a circular magnetic core having an insertion hole for inserting an electric cable therethrough, the case part includes, in a portion thereof to hold an outer peripheral surface of the divided core, an elastically deformable portion which protrudes outwardly relative to a surrounding area and is inwardly elastically deformable, the elastically deformable portion, when elastically deformed inwardly relative to the case part by a clamping band which applies an inwardly directed pressing force, pushes one of the divided cores toward the other one of the divided cores, the ferrite clamp further comprises the clamping band which engages with each of the elastically deformable portions and elastically deforms the elastically deformable portions inwardly relative to the case part so that the elastically deformable portions bias the divided cores toward and into engagement with one another, and an outer peripheral surface of each elastically deformable portion defines a band insertion hole for guiding over the respective elastically deformable portion.

14. The ferrite clamp according to claim 13, wherein a protruding portion is substantially axially aligned with the band insertion hole.

* * * * *